US006802320B2

(12) United States Patent
Janouch et al.

(10) Patent No.: US 6,802,320 B2
(45) Date of Patent: Oct. 12, 2004

(54) HAIR SHAPING APPLIANCES

(75) Inventors: Peter Janouch, Frankfurt (DE); Peter Lange, Eppstein (JP); Dieter Liebenthal, Maintal (DE); Silvia Rix, Schwalbach (DE); Heinz Kern, Königstein (DE); Peter Ruppert, Karben (DE); Friedrich Henninger, Kelkheim (DE); Jürgen Seng, Kelkheim (DE)

(73) Assignee: Braun GmbH, Kronberg ( * ) Notice: Subject to any disclaimer, the term of this patent is extended or adjusted under 35 U.S.C. 154(b) by 81 days.

(21) Appl. No.: 10/221,062

(22) PCT Filed: Mar. 8, 2001

(86) PCT No.: PCT/EP01/02604

§ 371 (c)(1),
(2), (4) Date: Sep. 9, 2002

(87) PCT Pub. No.: WO01/67915

PCT Pub. Date: Sep. 20, 2001

(65) Prior Publication Data

US 2003/0029854 A1 Feb. 13, 2003

(30) Foreign Application Priority Data

Mar. 13, 2000 (DE) ..... 100 12 194

(51) Int. Cl.[7] ..... A45D 2/22

(52) U.S. Cl. ..... 132/227; 132/221; 392/386; 126/401

(58) Field of Search ..... 132/221, 222, 132/223, 225, 226; 219/221, 222, 223, 225; 392/386, 395, 399; 126/401, 408, 409

(56) References Cited

U.S. PATENT DOCUMENTS

| | | | | |
|---|---|---|---|---|
| 3,835,292 A | | 9/1974 | Walter et al. | |
| 3,934,597 A | | 1/1976 | McNair | |
| 3,937,232 A | | 2/1976 | Tomaro | |
| 4,209,685 A | | 6/1980 | Walter et al. | |
| 4,502,465 A | * | 3/1985 | Yoshinaga et al. | 126/409 |

FOREIGN PATENT DOCUMENTS

| | | |
|---|---|---|
| CH | 597786 | 4/1978 |
| DE | 2631798 | 2/1978 |
| DE | 2653606 | 6/1978 |
| DE | 2804426 C2 | 11/1987 |
| WO | WO 95/13723 | 5/1995 |

* cited by examiner

*Primary Examiner*—Thor Campbell
(74) *Attorney, Agent, or Firm*—Fish & Richardson P.C.

(57) ABSTRACT

Appliances for shaping hair are provided. The hair-shaping appliances may include, for example, (a) a forward and reverse stroke liquid dosing device; (b) a tubular drum constructed to contact the hair, the tubular drum having through-passages; and (c) an evaporating device comprising an evaporator chamber to which a liquid is delivered by the dosing device, the evaporating device being constructed to produce steam from the delivered liquid and to deliver the steam through the through-passages in the tubular drum to treat the hair. Excess liquid is removed from the evaporator chamber by a return stroke of the dosing device.

35 Claims, 4 Drawing Sheets

HAIR SHAPING APPLIANCES

This application is filed under 35 USC §371 from PCT application number EP01/02604, filed Mar. 8, 2001, and claims priority under 35 USC §119 from German application number 1001219.2, filed Mar. 13, 2000.

BACKGROUND OF THE INVENTION

The invention relates to a hair-shaping appliance, in particular steam styling tongs, having a tubular drum which treats the hair and is provided with through-passages, having a heating device, in particular for heating up the drum, having a dosing device, upon the actuation of which liquid passes out of an outlet of a liquid container via a liquid-channeling device, having an evaporating device which is supplied with heat by the heating device and evaporates liquid into steam, and having a steam-distributor chamber which adjoins the evaporating device and via the through-passages of which steam flows outward.

DE-C-26 31 798, for example, discloses an apparatus for the metered discharge of liquid for a hair-shaping appliance, for example steam curling tongs. For the discharge of the steam, use is made of a pumping device which is provided with an elastic diaphragm, is integrated in a water tank and, in a metered manner, feeds water to a liquid-channeling device, preferably comprising a sponge with an adjoining nozzle, where the water then ultimately comes into contact with a heating plate for evaporation purposes. In order to improve the transportation of water in the liquid-channeling device, a one-way valve may be arranged on the water tank.

DE-C-26 34 '972 also discloses a hair-shaping appliance of the type described in the introduction. In the case of this hair-shaping appliance, the liquid-channeling device, preferably formed from a sponge and an adjoining tube, are inserted in a tubular housing. The tubular housing is arranged in a water tank, which can be filled with water and is likewise of tubular design, and, for the discharge of water, comprises two housing parts which can be displaced one inside the other counter to the force of a spring and, when displaced, serve for compressing the sponge and relieving the latter of loading. When the water tank is displaced counter to the force of a restoring spring supported on the drum, first of all the free end of the tube of the liquid-channeling device is brought into abutment against the heating device, until upon further displacement of the water tank, one housing part is displaced in the other housing part and compresses the sponge in the process. In this case, the sponge, for its part, discharges water, which then passes, via the liquid-channeling device, onto the surface of the heating device and evaporates there. The resulting steam passes outward into the free atmosphere via the through-passages formed on the drum.

Upon release of the evaporating device, the movable housing part is displaced away from the sponge again, on account of the pre-stressing of the spring, until its strike against an annular collar formed on the water tank. As stressing is relieved, air can penetrate into the chamber of the liquid container, via the equalizing bores formed on the sleeve, in order that no negative pressure forms in the chamber and no more water can thus flow out. The air taken in by suction flows around the outer surface of the sponge, on which the spring is centered, and thus passes into the chamber of the water tank.

In the case of this arrangement, it should be regarded as being less advantageous that if the evaporating device is actuated, for example, a number of times one after the other the heating device is fed more water than it can evaporate in the short period of time. Consequently, the evaporating device floods and excess water passes out at the through-passages. The result may be, on the one hand, that the hair is wetted too much but, on the other hand, also that the skin is burnt when the heated water passes out of the through-passages onto a user's skin. It is also possible, when the hair-shaping appliance is not used for a relatively long period of time, for the water located in the liquid container to flow, via the liquid-channeling device, into the steam-distributor chamber and to be capable of flowing outward, via the through-passages, there without evaporating beforehand. This may result, for example, in corrosive damage to the hair-shaping appliance or also in an excess amount of steam and/or hot water passing out when the appliance is next used, as a result of which a user could sustain burns.

JP-A-11 46839, furthermore, discloses a gas-operated hair-shaping appliance in the case of which flame-free combustion of a gas takes place by means of a catalyst for heating up the heating tube. Provided in this case too is a steam-distributor chamber which is supplied with water by a liquid container. The liquid container is provided with an exchange valve, via which air flows in when water flows out of the liquid container. As has already been mentioned above, it is also possible here, when the appliance is not in use, for water to pass into the steam chamber via the liquid-channeling device and then to pass outward via the through-passages. On account of the fact that the through-passages, which are connected to the evaporating chamber, are arranged in the hair-shaping appliance separately from the outlets, which are connected to the combustion chamber, differing temperatures may occur at various locations of the drum, i.e. the temperature at the outlets is usually considerably higher than the temperature at the through-passages. A result of this is the non-uniform distribution of hot waste gases and steam on the circumference of the drum.

DE-A-27 27 665 discloses a steam-emitting hair-shaping appliance with a control arrangement for regulating the flow-medium discharge of the type described in the introduction. In the case of this hair-shaping appliance, which is preferably designed as steam curling tongs, there is formed between the outlet of the liquid container and the evaporating device a bimetallic plate, which changes under temperature and only opens the outlet of the liquid container when a predetermined temperature is reached, with the result that water can pass into the evaporating device and evaporate there. This ensures that steam can only be emitted from the hair-shaping appliance within certain temperature limits.

SUMMARY OF THE INVENTION

The invention features an electric or gas-operated hair-shaping appliance, in particular steam styling tongs.

The invention can prevent liquid from passing out of the drum even in the case of the dosing or pumping device being actuated a number of times in quick succession. This should also be the case when the hair-shaping appliance is not in use.

In the case of gas-operated hair-shaping appliances, the invention can prevent the ignition and combustion operations of the catalyst from being adversely affected by liquid. The invention can simplify the construction and the assembly of the hair-shaping appliance and to reduce the production costs.

In one aspect of the invention features an appliance for shaping the hair, comprising a forward and reverse stroke liquid dosing device, a tubular drum constructed to contact the hair, the tubular drum having through-passages and an evaporating device. The evaporating device comprises an evaporator chamber, a heating device and a steam distributor chamber. The evaporating device is constructed to produce steam from liquid delivered to the evaporator chamber and to deliver the steam through the through-passages in the tubular drum to treat the hair. During the return stroke of the dosing device, the appliance removes excess liquid from the evaporator chamber preventing excess water from collecting in the evaporating device and potentially spilling out on the consumer during use or storage. Even when the dosing device is actuated a number of times in quick succession, the evaporating device can be prevented from overflowing since during the return stroke of the dosing or pumping device, on account of the "closed" liquid tank, excess water is sucked back into the water tank again via the liquid-channeling device. In addition, an undesirably high level of steam formation may be avoided by some aspects of the invention. Certain aspects of the invention can be used both for electrically operated and for gas-operated hair-shaping appliances.

In some implementations of the invention, the dosing device comprises, on the one hand, a pressure/suction pump operating on the displacement principle and, on the other hand, a liquid container, which can only be brought into connection with the atmosphere via its outlet. As a result, during the return stroke of the pressure/suction pump, excess liquid flows back into the liquid container via the liquid-channeling device. During the return stroke of the dosing or pumping device, the outlet also performs the function of an inlet for excess water which collects in the evaporator chamber or still adheres to the liquid-channeling device as an excess droplet.

Of course, it is also conceivable, instead of the liquid container provided, to integrate a further liquid container in the appliance, which is then provided with a separately working liquid-channeling device which channels excess water back into said second container.

Since excess liquid flows back immediately into the liquid container from the evaporating device, the hair-shaping appliance can be held as desired in a user's hand without liquid passing out of the drum via the through-passages. This results in a particularly economical water-discharging device. That is to say, the liquid located in the liquid container is fully converted into steam without some of the water running out of the appliance unused.

In some implementations of the invention, the evaporating device comprises an evaporator surface which is located opposite the outlet, and in that the evaporator surface is part of an evaporator chamber which receives and discharges the liquid. This prevents the water which is discharged by the dosing device during the actuation will not escape even when the hair-shaping appliance is in the horizontal position. The chamber may form a relatively large evaporating surface and is constructed to retain small water droplets. It is possible here for the chamber to be of plate-like, cup-like or pot-like design.

In some implementations of the invention, the liquid-channeling device comprises a wick which is fastened in the outlet and of which the free, delivering end terminates a small distance in front of the evaporator surface when liquid is discharged or received. This can reduce exposure of the wick to an excessively high temperature. This increases the service life of the wick. Moreover, the wicks need not be pressed against the evaporating surface in order for water to be discharged in a metered manner. It is also possible, however, upon actuation, for the wick to come into contact with the evaporator plate and to be pressed against it slightly in the process.

In some other implementations of the invention, the wick can transport both water and air in both directions of flow. This arrangement allows for a straightforward metering of the liquid.

In some other implementations of the invention, the end of the wick opposite the evaporator chamber projects into the liquid container. This provides a relatively large receiving surface for the liquid on the wick, and allows for a liquid to be drawn from the liquid container even when the liquid container is in the horizontal position or is almost empty.

In other implementations of the invention, the wick is spaced from the evaporating surface a sufficiently small distance so that, during actuation of the dosing device, a droplet of water protruding off a surface of the wick can come into contact with the evaporating surface and for parts of the droplet to flow out, these then evaporating on the hot evaporator-chamber surface.

In yet other implementations of the invention, the dosing device and the chamber of the liquid container form a piston/cylinder arrangement, with the dosing device representing the cylinder and the chamber representing the piston. This allows for a particularly straightforward integration of the dosing device with the liquid container. This allows for delivery of a relatively large or small amount of liquid, depending upon piston stroke length. In this case, the piston has to be displaced into its starting position again, by means of a spring, in order for the automatic suction stroke to be executed.

In other implementations of the invention, the dosing device comprises an elastically deformable wall which forms part of the liquid container. The elastically deformable wall can easily be actuated for discharging liquid. In addition, the wall moves back automatically to its original shape again because of its elastic expandability, allowing for the suction stroke to be executed without a user's intervention. The elastically deformable wall may be fastened on the liquid container, for example, by injection molding, screw connection, adhesive bonding or in some other manner, but it may also be designed as an integral molding with the liquid container. In this case, the wall thicknesses should be coordinated with one another such that, upon actuation of the deformable wall, the liquid container itself hardly deforms.

It is advantageous for the deformable wall to be outwardly curved so that the dosing device can discharge considerable quantities of liquid. The elastically deformable material and the wall thickness of the deformable wall have to be selected such that the wall can be easily moved by hand and the wall produces a sufficient suction-stroke action in the chamber of the liquid container so that excess water which may be present in the evaporating chamber or on the wick can be sucked back into the liquid container sufficiently quickly via the liquid-channeling device.

In still other implementations of the invention, the liquid container can be displaced in the axial longitudinal direction of the hair-shaping appliance in an insulating sleeve fastened in the drum, counter to the force of a compression spring. The outlet, with its liquid-channeling device is formed at the end of the liquid container which is located opposite the evaporator surface, and the deformable wall is formed at the other, remote end of the liquid container. Marked deformation of the elastically deformable wall happens when the liquid container, once displaced, moves against a stop. This ensures that water only flows into the evaporating chamber when the liquid-channeling device butts against the base of the evaporating chamber or, better, terminates a short distance in front of said chamber. The rigidity of the elastically deformable wall is thus selected to be high enough for the liquid container, initially without any marked elastic deformation of the wall, to be displaced counter to the force of the compression spring until the wick has reached its liquid-discharging position in the evaporating chamber. This ensures that excess liquid will be channeled back into the liquid container via the wick. For easy displacement of the liquid container, the latter is fastened in a non-displaceable manner in the drum in an insulating sleeve, which is fastened in a stationary manner in the drum. The insulating sleeve protects the liquid container, which is preferably plastic, from thermal overloading.

In other implementations, the deformable wall is replaceable. The replaceable wall may be connected to the liquid container by means of a thread, a clip device or by any other means.

In still other implementations, at least one stub or radially extending protrusion projects on the outer surface of the liquid container and, following the insertion of the liquid container, the stub engages in a bayonet-like manner behind a recess formed on the insulating sleeve. The recess is adjoined by a gap which runs in the longitudinal direction of the insulating sleeve and allows further displacement of the liquid container in the direction of the evaporator surface. This allows the liquid container to be easily removed from the hair-shaping appliance in order to be filled with a liquid, preferably water or water enriched with fragrances, hair-treating substances or other materials. Locking takes place when at least one stub projecting radially on the liquid container initially engages in a recess, when inserted, and is then secured by rotation, but can be moved back and forth within certain limits in the longitudinal direction of the liquid container by means of a further recess adjoining the first recess. Instead of one stub, of course, it is also possible for two or more stubs to be formed on the circumference of the liquid container. In this situation, it is also necessary to introduce into the sleeve a corresponding number of recesses, which then cooperate with the respectively associated stub. This improves the guidance of the liquid container.

In other implementations, the base of the liquid container is formed by a sleeve with an outlet and connected to the outlet and projecting out of the sleeve is the liquid-channeling device. The sleeve is fastened releasably on a tube of the liquid container by means of a second releasable connection, preferably a bayonet closure or thread connection. This ensures that only when the liquid container has been removed from the hair-shaping appliance that it can be filled with water, once the closure cap has been opened. The operation of removing the liquid container from the hair-shaping appliance, which is necessary for filling the liquid container, can avoid malfunctioning of, and thus possible damage to, the hair-shaping appliance, because a user is never tempted to hold the entire appliance under a water source during the filling operation. The forced separation of the liquid container from the hair-shaping appliance facilitates handling of the filling operation since, in this case, the hair-shaping appliance can be set to one side and the liquid container can be held more easily under a faucet or a container.

In still other implementations, on the outer wall of the sleeve is formed a stop on which the compression spring is supported on one side, and formed on the inner wall of the insulating sleeve is a base on which the other side of the compression spring is supported. This allows for following actuation, the water tank is automatically moved back into its starting position again by the force of the compression spring as soon as the actuating force applied to the elastic wall by a user decreases.

In still other implementations, mounted on the external diameter of the compression spring is a sealing ring, of which one end butts with sealing action against an end surface of the sleeve and the other end butts with sealing and sliding action against the inner wall of the insulating sleeve. This allows for the compression spring, in addition to serving as a restoring spring for the liquid container, also performs the retaining and sealing function of the sealing ring which butts with sealing action against the liquid container and seals the evaporator chamber in relation to the bore formed in the insulating sleeve and also in relation to the liquid container. The sealing ring here butts with sliding action in the bore of the insulating sleeve, to seal the evaporator chamber when the liquid container is displaced.

In the case of a hair-shaping appliance that heats by using flame combustion of a gas by means of a catalyst, the insulating sleeve can be introduced into the drum to such an extent that a steam-permeable ring, preferably a felt element, is clamped in between the free end of the insulating sleeve and the side end of an evaporator chamber formed by the evaporator plate, so that the steam produced in the evaporator chamber can only pass into the steam-distributor chamber via the steam-permeable ring. This allows for a particularly straightforward arrangement of the catalyst and the steam-distributor chamber being formed in a common chamber. The evaporating chamber no longer needs to be hermetically sealed in relation to the combustion chamber. This allows for better mixing of the steam and the combustion gases and thus can heat up more uniformly. This may allow a more uniformly hot jet of steam to pass out at the through-passages formed in the drum. In addition, the drum is also heated up better and more uniformly in this way.

Allowing water droplets to pass onto the catalyst, can cause considerable ignition problems since a comparatively large amount of ignition energy would have to be applied in order for the water located on the catalyst to evaporate and to ignite said catalyst for the flame-free combustion process. A single chamber simplifies the construction of the hair-shaping appliance to a considerable extent and, in addition to the abovementioned advantages, may reduce the production costs.

DESCRIPTION OF EMBODIMENTS

Figure 1:
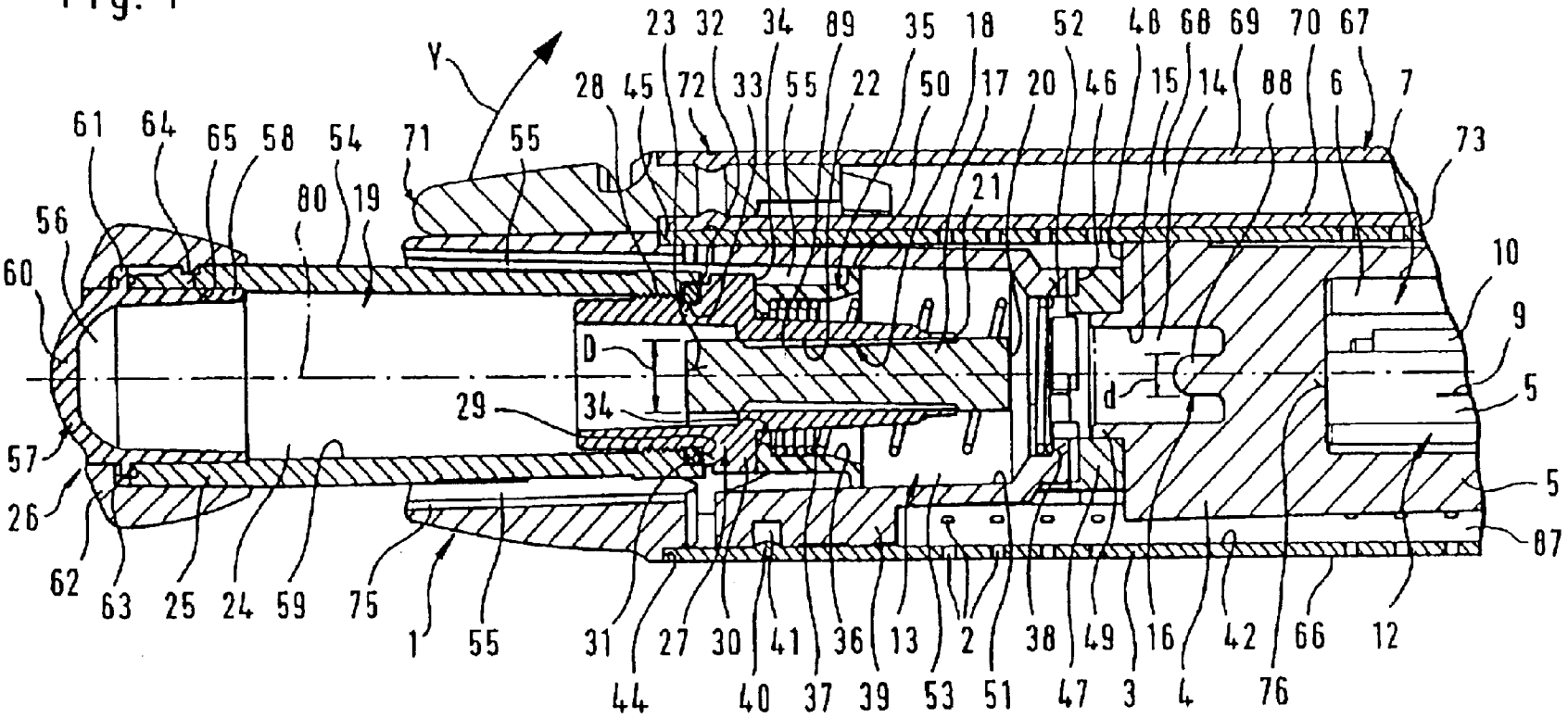
FIG. 1 shows, on an enlarged scale, a partial longitudinal section through the front region of a hair-shaping appliance according to the invention, the dosing device being located in its non-actuated, starting position.
Figure 3:
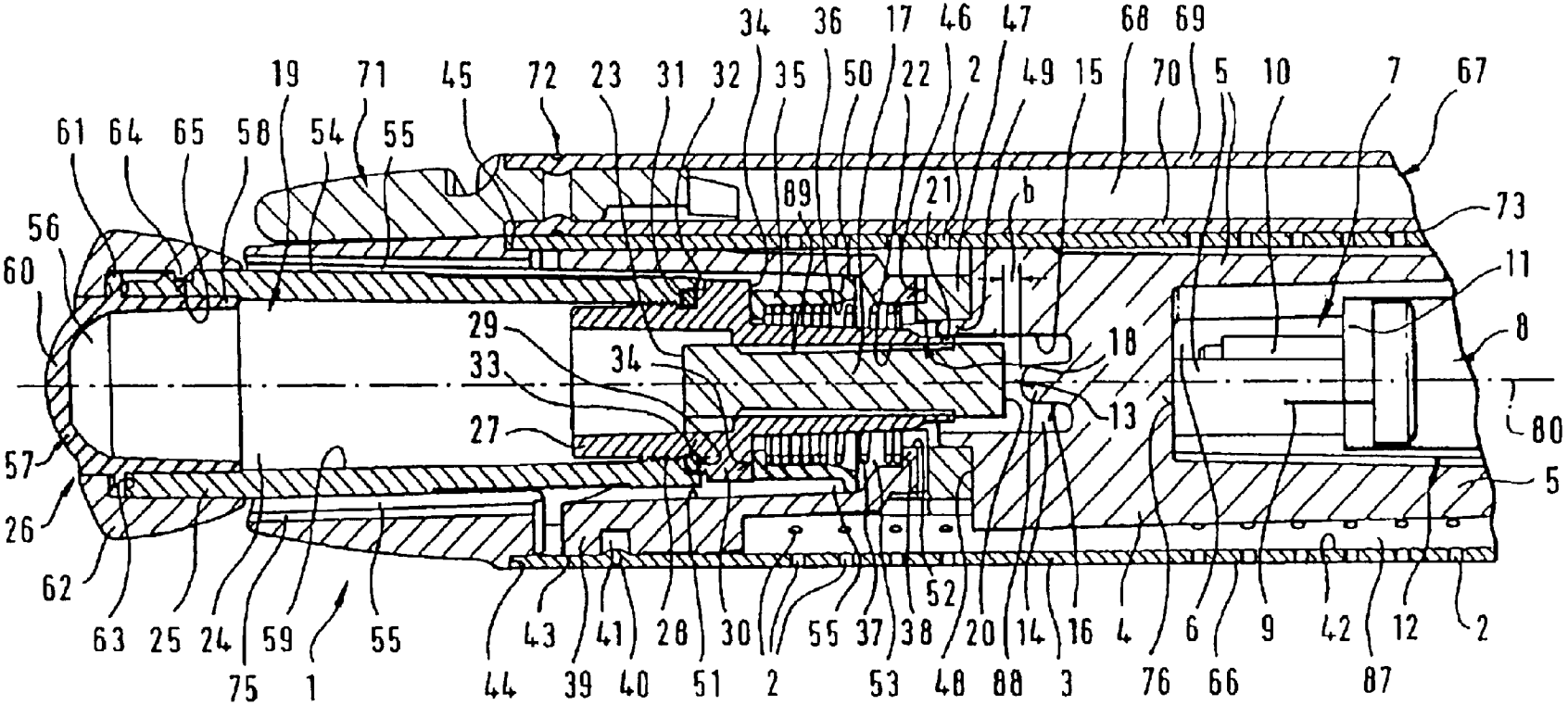
FIG. 3 shows a partial longitudinal section through the hair-shaping appliance according to the invention corresponding to FIG. 1, with the dosing device in the actuated position.

The hair-shaping appliance 1, which is preferably designed in the form of steam styling tongs, comprises, according to FIGS. 1 and 3, a tubular drum 3 which treats the hair (not illustrated), is provided with through-passages 2 and in the central section of which there is formed an evaporator plate 4 which, according to FIGS. 1 and 3, has diametrically opposite crosspieces 5 which run to the right and between which openings 6 are formed. The crosspieces 5 enclose an accommodating space 7, in which a tubular catalyst 8 is formed as part of a heating device 12, in which flame-free combustion of a gas (not illustrated) takes place during the heating operation, the gas passing out of a cartridge (not illustrated in the drawing) and flowing into a mixing/regulating and valve device (not illustrated either).

The catalyst 8 essentially comprises a tubular steel mesh with a surface coating which consists of platinum or palladium and on which the flame-free combustion takes place. Projecting at the free end 11 of the catalyst 8 are thin ignition filaments 9 which are produced from wire, serve for easy ignition during start-up of the catalyst 8 and thus initiate the heating operation of the heating device 12. Projecting into the opening 6 from right to left is a control rod 10, which is controlled by the temperature and, in dependence on the temperature set, controls the feed of gas to the catalyst 8 via the valve device.

Opposite the base 76 of the opening 6, an evaporating device 13 is arranged within the drum 3, said device comprising an evaporator chamber 14, designed as a blind bore 15, with an evaporating surface 16. The evaporator chamber 14 is part of the evaporator plate 4 and likewise runs concentrically in relation to the drum 3. In addition, the evaporating device 13 preferably consists of a felt or a similar air-permeable and water-permeable wick material, which forms the liquid-channeling device 17 which is fastened in the outlet 18 of a liquid container 19. The free end 20 of the wick 17 projects at the border 21 of the outlet 18. The wick 17 is compressed by the wall of the bore 22 firmly enough in order to be retained in a nonslip manner in the bore 22 of the outlet 18. The wick 17 has its other free end 23 projecting into the liquid-accommodating, preferably water-accommodating, chamber 24 of the liquid container 19 in order to form a sufficiently large receiving surface for the liquid. The liquid container 19 has not been filled with a liquid, so it is not possible for this to be designated either.

According to FIGS. 1 and 3, the liquid container 19 comprises a tube 25, of which the outer end is provided with a dosing device 26, while the other end, which is located in the drum 3, is provided with a sleeve 27 on the base. The outlet 18 with the wick 17 is arranged in the sleeve 27. The sleeve 27 projects into the tube 25 and is screw-connected there with sealing action by means of a thread 28 or bayonet closure (not illustrated). The sleeve 27 has a projecting annular collar 30, of which the annular surface 29, which is directed toward the dosing device 26, has an O-ring 31 supported on it, this O-ring being pressed against the free end 32 of the tube 25 and thus producing a sealed connection between the sleeve 27 and the tube 25. The O-ring 31 is retained in a stationary manner in an annular groove 33, which is formed in the sleeve 27, in order that said O-ring, when the liquid container 19 is filled, does not slide down from the sleeve 27, by virtue of the latter being unscrewed, and go missing, with the sealing of the liquid container 19 being eliminated as a result.

According to FIGS. 1 and 3, a sealing ring 35, in the bore 36 of which a compression spring 37 is retained in a stationary manner, is supported on the end surface 34 of the annular collar 30, said end surface being directed toward the evaporator chamber 14. The compression spring 37 has its other end supported on the base 38 of an insulating sleeve 39. The sealing ring 35 is produced from elastomeric material and, by way of its annular sealing surface 50, slides, with sealing action, along the inner bore 51 of the insulating sleeve 39. At the same time, the other end of the guide sleeve 35 butts with sealing action against the end surface 34, with the result that the annular chamber 53, which is connected to the evaporator chamber 14 via the bore 52, is closed with sealing action in the direction of the atmosphere. This is because an annular space 55 is provided between the outer surface 54 of the tube 25 and the bore 51, it being possible for air to pass to the sealing surface 50 of the guide sleeve 35 via said annular space. The annular space 55 may be of very small dimensions, in order to ensure tilting-free guidance of the liquid container 19 in the insulating sleeve 39.

Figure 2:
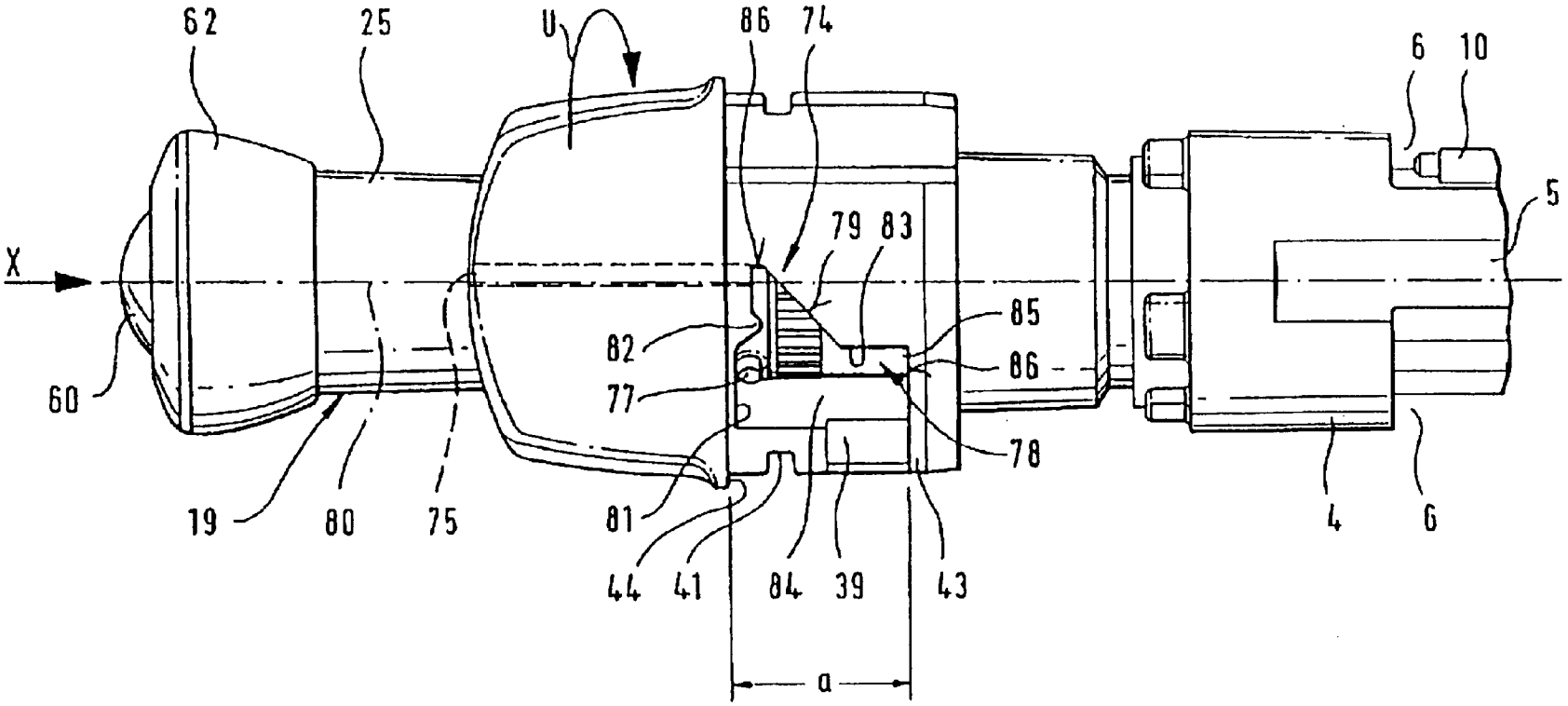
FIG. 2 shows a side view of the insulating sleeve with dosing device inserted therein and of the evaporator plate, before this unit is inserted into the drum and the insulating sleeve is connected in a form-fitting and non-releasable manner to the drum, the unit having been rotated such that it is possible to see the region of the locking location between the liquid container and the sleeve.
Figure 4:
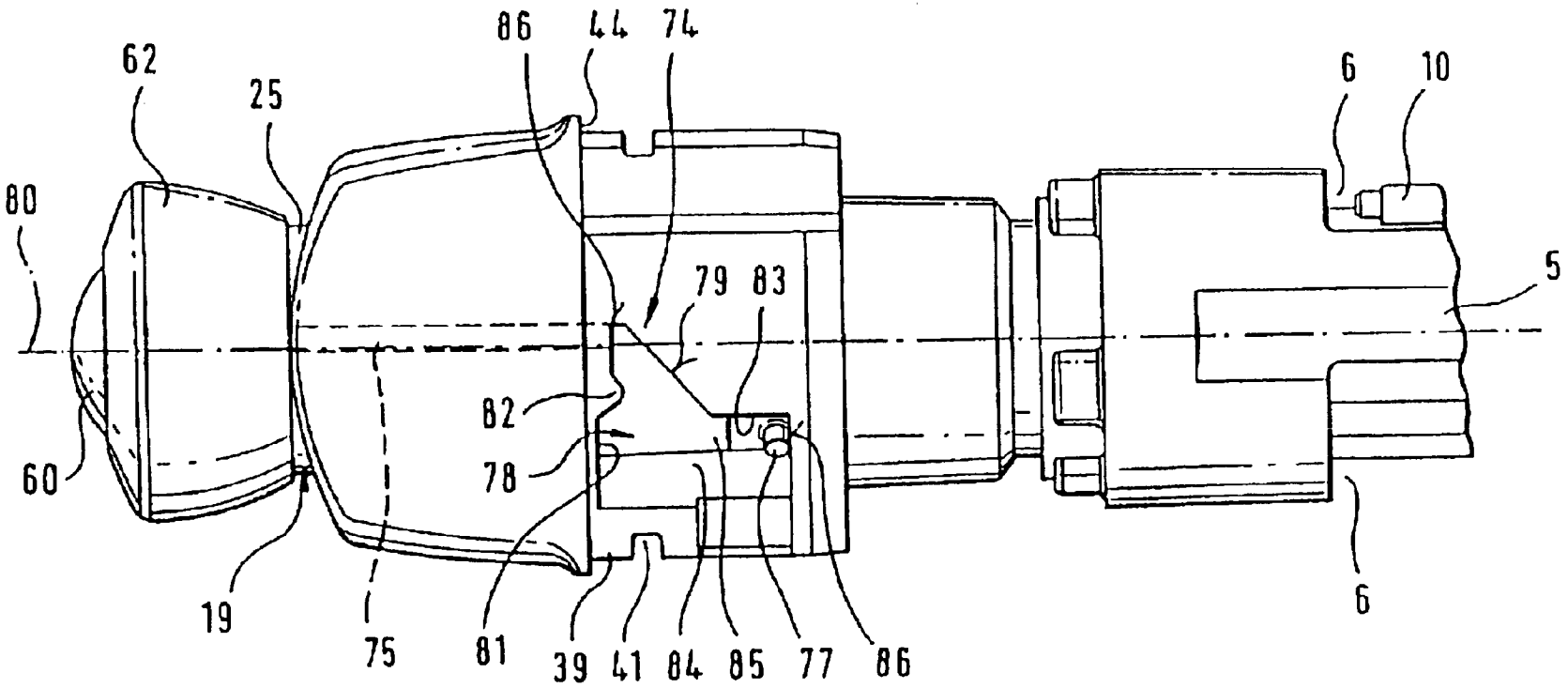
FIG. 4 shows a side view of the insulating sleeve with dosing device and evaporator plate according to FIG. 2, albeit with the dosing device in the actuated position according to FIG. 3.

According to FIGS. 1 and 3, the insulating sleeve 39 is firmly connected to the drum 3 preferably by crimping. During the crimping, material 40 of the drum 3 is pressed plastically into depressions 41 formed on the insulating sleeve 39. FIGS. 2 and 4 show the insulating sleeve 39 before it is inserted into the bore 42 of the drum 3 and crimped. The insulating sleeve 39 is centered in the bore 42 by way of its outer surface 43 and strikes against the free end 45 of the drum 3 by way of its end surface 44 and, in this way, always has a fixed arrangement in relation to the drum 3. The insulating sleeve 39 encloses part of the liquid container 19, the sleeve 27 and the evaporating device 13 concentrically.

Supported, according to FIGS. 1 and 3, on the annular surface 46 of the insulating sleeve 39, said annular surface being closer to the evaporator chamber 14, is an annular felt element 47 which, by way of its other side, butts against an annular surface 48 of the evaporator plate 4. The annular felt element 47 is clamped in between the two annular surfaces 46, 48 such that it always maintains this position in captive fashion. In order for it also to be centered in the radial direction, an annular collar 49 projecting from the annular surface 48 engages on the inner surface. That end of the tube 25 which projects to the left out of the insulating sleeve 39 is provided with an opening. 56, which is closed by a stopper 57. The cylindrical section 58 of the stopper 57 projects into the through-passage bore 59 of the tube 25 and is centered there. The base 60 of the stopper 57 is formed by a flexible diaphragm, with the result that upon actuation, for example by a user's finger applying pressure to it from the outside, said diaphragm deforms in the direction of the chamber 24 such that the chamber 24 is thus reduced in size and liquid is delivered into the evaporator chamber 14 via the wick 17.

An annular collar 61 is formed on the outer surface of the transition from the cylindrical section 58 to the base 60 and is pressed with sealing action, by a retaining ring 62, into abutment against the end surface 63 formed at the free end of the tube 25. The retaining ring 62 itself is firmly connected to the tube 25 via retaining noses 64, which engage resiliently in latching holes 65 formed on the outer surface of the tube 25. This connection constitutes a type of clipping or snap-in device, in the case of which the annular collar 61 is elastically deformed until the retaining noses 64 spring resiliently into the latching holes 65 and thus, in the manner of a barb, are no longer capable of sliding out of the latching holes 65. The opening 56 of the tube 25 is closed with sealing action in this way. The diaphragm 60 and the cylindrical section 58 of the stopper 57 are formed integrally from an elastic polymer material. The diaphragm 60 forms the pressure/suction pump and/or the dosing device 26 for the liquid container 19.

As can also be seen from FIGS. 1 and 3, a clamp 67, which is generally customary in the case of such hair-shaping appliances 1, butts against the outer lateral surface 66 in the top region, it being possible for said clamp to be pivoted upward, in arrow direction Y, by hand on the right-hand side, about a point of rotation not illustrated in the drawing, in order for it to be possible for hair (not illustrated) to be wound around the outer lateral surface 66 of the drum 3, said hair then being clamped in between the outer lateral surface 66 and the clamp 67 by the downwardly moving clamp 67. The clamp 67 is of double-walled design and, at its free end, is closed in the forward direction by a stopper 71 engaging in the cavity 68 of the two walls 69, 70. The stopper 71 is likewise firmly connected to the walls 69, 70 by a crimping device 72. The clamp 67 runs concentrically in relation to the outer lateral surface 66 of the drum 3, as seen in cross section, and thus butts against the same, more or less flush against the outer lateral surface 66, if there is no hair positioned in the gap 73. The width of the gap 73 is at its smallest in this position.

FIGS. 2 and 4 illustrate the dosing device 26 with the liquid container 19, with the insulating sleeve 39 and with the evaporator plate 4 as an installation part which has been removed from the drum 3, in order for it to be possible to show the bayonet closure 74 between the liquid container 19 and the insulating sleeve 39. Formed on the inner bore 51 of the insulating sleeve 39, in the front left-hand section according to FIGS. 1 to 4, are diametrically opposite guide or insertion grooves 75 (these are only illustrated by dashed lines in FIGS. 2 and 4) in which, when the liquid container 19 is inserted into the insulating sleeve 39, likewise diametrically opposite stubs 77, which project on the outer surface 54 of the tube 25, engage until, following further displacement of the liquid container 19 according to FIGS. 1 to 4 to the right, these stubs 77 engage in a recess 78 formed on the insulating sleeve. Upon further displacement in the direction X, the stub strikes against a ramp 79 of the recess 78 and, since the insulating sleeve 39 is fastened in a rotationally fixed manner in the drum 3, the tube 25, and thus the entire liquid container 19, is rotated in the direction of rotation U, which runs in the clockwise direction. Upon release, the liquid container 19, with the stub 77, is moved longitudinally parallel to the center axis, counter to the displacement direction X, without rotating by the force of the compression spring 37 until the stub 77 strikes against a stop surface 81 of the recess 78, which can be seen from FIG. 2. In this case, the stub 77 engages behind a blocking protuberance 82, which is formed on the stop surface 81 and prevents the liquid container 19, for example on account of vibrations acting on it, from being able to rotate automatically counter to the direction of rotation U, in which case the stub 77, in turn, could reach the guide groove 75 and thus drop out of the insulating sleeve 39. The compression spring 37 thus always presses the liquid container 19, and thus the stub 77, with pre-stressing against the stop surface 81.

According to FIGS. 2 and 4, the ramp 79 is adjoined by an end surface 83 which runs parallel to the center axis 80 and, with the boundary surface 84 located opposite the ramp 79 and the end surface 83, forms a gap 85 in the recess 78, in which, upon axial displacement of the liquid container 19 in the direction X, the stub 77 can engage until it strikes against the stop surface 86 and, from there on, no further displacement of the liquid container 19 is possible, as FIG. 4 clearly shows. In this position, the free end 20 of the wick 17 terminates at a small distance in front of the evaporator surface 16. The distance is only a few millimeters. It is also conceivable, however, for the free end 20 of the wick 17 to strike against the evaporator surface 16 even in the actuating position illustrated in FIGS. 3 and 4.

Operation and functioning of the hair-shaping appliance 1 according to the invention are as follows:

1. Removal of the liquid container 19 from the hair-shaping appliance 1 and filling of said container with a liquid, preferably water:

According to FIG. 2, the retaining ring 62 is pressed firmly by hand in the actuating direction X such that the liquid container 19 is displaced to the right counter to the force of the compression spring 37. The stub 77 lifts off from the stop surface 81 in the process. At the same time, the liquid container 19 is rotated in the circumferential direction U by hand until the stub 77 strikes against the boundary surface 86 of the recess 78 and is aligned with the guide groove 75. On account of the pre-stressed compression spring 37, when the hand is released from the retaining ring 62 and/or the diaphragm 60 of the liquid container 19, the latter is displaced counter to the direction X and the stub 77 slides to the left in the guide groove 75 according to FIG. 2. As soon as the pre-stressing force of the compression spring 37 has been used up, the liquid container 19 can then be removed by hand from the inner bore 51 of the sleeve 27 and thus from the drum 3. The removed liquid container 19 comprises the dosing device 26, the tube 25, the sleeve 27, the O-ring 31 and the wick 17. The compression spring 37 remains, with the sealing ring 35, in the inner bore 51 since the right-hand end of the compression spring 37 has been pressed in slightly in the: bore 52 of the sleeve 27. The other end of the compression spring 37 is seated in the bore 36 of the sealing ring 35, likewise with a small amount of pre-stressing, and thus also secures the sealing ring 35.

The removed liquid container 19 (not illustrated) can then be opened by the sleeve 27 being unscrewed from the thread 28. In this case, the O-ring 31 remains seated firmly in the groove 33 and thus cannot go missing. The same applies to the wick 17, which has been inserted in the bore 22 likewise under pre-stressing. This is also shown by the individual ribs 89 projecting in the bore 22. The tube 25 with its dosing device 26 can then be held under a faucet or a liquid-discharging location (not illustrated) and the tube 25 can be filled with a liquid via the freed through-passage bore 59. The sleeve 27 is then screwed to the tube 25 again until such time as the O-ring 31 butts in a pressure-tight manner against the free end 32 of the tube 25 and liquid can thus only pass outward via the wick 17.

2. Insertion of the liquid container 19 into the hair-shaping appliance 1:

The liquid-filled liquid container 19, according to FIG. 1, is inserted into the inner bore 51 of the insulating sleeve 39 with the wick 17 in front, it being necessary to ensure that the stub or stubs 77 engages/engage in the guide grooves 75. In this position, the liquid container 19 is not initially rotatable. The liquid container 19 is then pushed into the insulating sleeve 39 to the extent where the stub or stubs 77 strikes/strike against the ramp or ramps 79. Upon further displacement of the liquid container 19 in the direction X, said container is then automatically rotated counter to the direction of rotation U by the stubs 77 sliding up the ramp 79. When the liquid container 19 is pushed into the insulating sleeve 39, first of all the end surface 34 of the sleeve 27 strikes against the end surface 34 of the sealing ring 35 and, upon further displacement of the liquid container 19 in the direction X, the sealing ring 35 is then carried along to the right and the compression spring 37 is pre-stressed in the process. It should be noted, at this stage, that two bayonet closures 74 may be formed diametrically opposite one another, for better centering of the liquid container 19, in the insulating sleeve 39.

Once the liquid container 19, then, has been rotated to a sufficient extent, and the compression spring 37 has also been pre-stressed to a correspondingly high level, the manual force acting on the liquid container 19 can then decrease to the extent where the force of the compression spring 37 displaces the liquid container 19 counter to the direction X again until the stub 77 engages behind the blocking protuberance 82 and strikes against the stop surface 81 in the process. The position of the liquid container 19 according to FIGS. 1 and 2 has been reached and the hair-shaping appliance 1 is then ready for operation.

3. Operation of the hair-shaping appliance according to the invention during the discharge of steam:

Once a valve device, which is not illustrated in the drawing, has been rotated into its open position by hand, gas flows into the catalyst 8 and it is likewise possible, via a further ignition button (not illustrated in the drawing), for the ignition device (which is not illustrated either) to be ignited. On account of an explosion, the ignition filaments 9 achieve their operating temperature, i.e. they begin to ignite by the flame-free combustion. This high temperature is then transmitted to the catalyst 8, which is activated in this way. The evaporator plate 4 is then heated until the control rod 10 cuts back the gas feed. The desired operating temperature at the evaporator plate 4 is then automatically controlled by the control rod 10 by virtue of the valve device being opened and closed. The heat discharged from the catalyst also penetrates, via the openings 6 (FIGS. 2 and 4), into the steam-distributing space 87 formed between the evaporator plate 4 and the bore 42 of the drum 3, with the result that the bore 42, and thus the drum 3, is also heated. The combustion gases produced in the catalyst 8 are likewise delivered, via the openings 6, into the steam-distributing space 87 and, from there, to the outside via the through-passages 2. This operation takes place until such time as the hair-shaping appliance is sufficiently hot.

A user can then pick up the hair-shaping appliance 1 via its handle, which is not illustrated in the drawing but is formed on the right-hand side of the hair-shaping appliance 1 according to FIGS. 1 to 4, and move it toward his/her head, the clamp 67 first of all being pivoted open and hair being positioned in the resulting gap 73, it then being possible for said hair to be wound around the outer lateral surface 66 of the drum 3.

A user can then use a finger of his/her other hand (not illustrated) to press on the base 60 of the dosing device 26 until such time as the liquid container 19 is displaced in the direction X counter to the force of the compression spring 37. In this actuating position, the base 60 of the diaphragm hardly deforms at all since the deformation force which is necessary for deforming the base 60 is greater than the force which is necessary for compressing the compression spring 37. This means that first of all the liquid container 19 is displaced in the direction X, counter to the compressive force of the compression spring 37, until such time as the stub 77 strikes against the boundary surface 86 of the recess 78, as can clearly be seen in FIG. 4 in particular.

If force then continues to be applied to the base 60 of the dosing device 26, the base 60 deforms into the through-passage bore 59 of the tube 25, although this is not illustrated in the drawing. With this deformation of the base 60, the liquid located in the liquid container 19 is then forced through the wick 17, with the result that liquid in the form of droplets (not illustrated) passes out at the free end 20. Since there is only a very small distance b between the free end 20 of the wick 17 and the evaporator surface 16 in this position (FIG. 3)—said distance being approximately 1 to 5 mm—the droplet comes into contact with the evaporator surface 16, and can thus evaporate, before it can drop off. If the base 60 is pressed firmly enough for a plurality of liquid droplets to pass out at the free end 20 of the wick 17, then the evaporator chamber 14 is filled to a greater or lesser extent with liquid. The liquid can then partially or wholly evaporate, provided that pressure continues to be applied to the base 60 of the dosing device 26.

The steam formed in the evaporator chamber 14, according to FIGS. 1 and 3, is then guided into the annular chamber 53, from where it penetrates the annular felt element 47. Water droplets are restrained by the felt element or wick 47. It is also the case that steam and water cannot pass into the annular space 55, which is open to the atmosphere, since the sealing ring 35 is sealed in relation to the inner bore 51 and the sleeve 27. Once the steam has penetrated the felt element 47, it passes into the steam-distributing space 87, is heated up there again and leaves the through-passages 2 in the outward direction together with the combustion gases. This steam penetrates into a user's hair, heats the hair and, at the same time, wets it in order that it can be shaped better.

As soon as the pressure on the base 60 of the dosing device 26 decreases, and said pressure is then smaller than the force applied by the compression spring 37, the liquid container 19 is displaced to the left, counter to the direction X, until, in turn, the stub 77 strikes against the stop surface 81. When the force is removed from the base 60, the base deforms again into the starting position illustrated in FIGS. 1 to 4, that is to say a negative pressure is produced in the chamber 24 of the liquid container 19 and ensures that the excess liquid in the wick 17 and/or in the evaporator chamber 14, that is to say liquid which has not yet been converted into steam, is sucked back into the chamber 24 via the wick 17. This avoids any more liquid being evaporated than is desired by a user.

This is because, via the actuation of the base 60 of the dosing device 26, it is very difficult to meter the precise quantity of water which is to be evaporated in the evaporator chamber 14. For this reason, it is possible, if too much liquid has passed into the evaporator chamber 14, for example, on account of excessively pronounced actuation of the base 60 and/or of the dosing device 26, for said liquid to be sucked back abruptly into the chamber 24 of the liquid container 19 again via the wick 17. In this case, the steam delivery is adjusted in an abrupt manner. This produces a hair-shaping appliance 1 with very economical water consumption for producing steam.

It is also the case that it is no longer possible when the hair-shaping appliance 1 is not in use, that is to say when the hair-shaping appliance 1 is not used for a relatively long period of time, for the liquid which is still located in the chamber 24 of the liquid container 19 to run out of the latter and pass out as non-evaporated water at the through-passages 2 or even to be able to pass to the catalyst 8 via the openings 6. This is because the latter possibility would render the next ignition operation difficult, or would even make it impossible to activate the catalyst 8, because, for this purpose, an excessively high level of ignition energy would be necessary in order first of all to drive the liquid out of the catalyst 8.

According to the invention, it is thus not possible for the liquid to run out of the liquid container 19 because the dosing device 26 closes the liquid container 19 with sealing action and liquid can only run out via the wick 17 when the dosing device 26 is actuated and at the same time, during the return stroke, air flows into the liquid container 19 via the wick 17. Since, however, the wick 17 is dimensioned such that, in the pressure-free state, no air can penetrate into the chamber 24 via the same, it is not possible either for any liquid to run out of the liquid container 19 without external action.

When the liquid tank 19 is displaced, the base 60 is merely subjected to an axially directed force applied by hand, with the result that rotation and thus the possibility of the liquid container 19 dropping out of the hair-shaping appliance 1 when the force is released are barely possible. The maximum displacement of the liquid container 19 is provided by the distance a between the stop surface 81 and the boundary surface 86. This precisely defines the minimum distance b between the free end 20 of the wick 17 and the evaporator surface 16 (FIG. 3).

It should also be mentioned that the evaporator surface 16 is provided with a stub-like elevation 88, of which the average diameter d is smaller than the diameter of the free end 20 of the wick 17 (FIG. 1). Furthermore, the stub-like elevation 88 is also rounded at its free end in order thus for the wick 17 to be subjected to the action of as little heat as possible. This increases the service life of the wick 17. The stub-like elevation 88 also advantageously serves to provide the largest possible evaporator surface 16, by means of which the largest possible quantity of steam can be produced in a comparatively short period of time.

Once a curl (not illustrated) has been sufficiently subjected to the action of steam and heat, and has thus achieved a comparatively stable form, the clamp 67 can be opened by hand again and the curled sections of hair can be removed from the hair-shaping appliance. The operation can then be repeated on further sections of hair.

What is claimed is:

1. An appliance for shaping hair, comprising:

a forward and reverse stroke liquid dosing device;

a tubular drum constructed to contact the hair, the tubular drum having through-passages;

an evaporating device comprising an evaporator chamber to which a liquid is delivered by the dosing device, the evaporating device being constructed to produce steam from the delivered liquid and to deliver the steam through the through-passages in the tubular drum to treat the hair;

a liquid container, in fluid communication with the evaporator chamber, constructed to contain a supply of the liquid and including an outlet; and a liquid channeling device, in fluid communication with the outlet, for delivering liquid from the outlet to the evaporator chamber, the liquid channeling device comprising a wick;

wherein excess liquid is removed from the evaporator chamber by a return stroke of the dosing device.

2. The appliance of claim 1 wherein the dosing device is contructed to return excess liquid removed from the evaporator chamber to the liquid container.

3. The appliance of claim 1 wherein the liquid is delivered to the evaporator chamber by a forward stroke of the dosing device.

4. The appliance of claim 1 wherein the excess liquid is removed to a receiving container different from the liquid container.

5. The appliance of claim 1 wherein the liquid dosing device comprises a mechanical pump.

6. The appliance of claim 1 wherein the liquid dosing device comprises a pressure/suction pump.

7. The appliance of claim 6 further comprising a closed liquid container having only one outlet, said outlet also functioning as an inlet to receive the excess liquid from evaporator chamber.

8. The appliance of claim 7 wherein the liquid is delivered to the evaporator chamber from the liquid container and the excess liquid is removed to a receiving container different from the liquid container.

9. The appliance of claim 1 further comprising a closed liquid container having only one outlet, said outlet also functioning as an inlet to receive the excess liquid from evaporator chamber.

10. The appliance of claim 1 wherein the evaporating surface comprises a flat or convex structure.

11. The appliance of claim 1 wherein a first end of the wick projects into the liquid container.

12. The appliance of claim 1 wherein the wick is replaceable.

13. The appliance of claim 11 wherein the wick is movable between a first normal position and a second, extended position, in which a second end of the wick extends into the evaporator chamber.

14. The appliance of claim 1 wherein the first end of the wick is in close proximity to an inner wall of the liquid container.

15. The appliance of claim 13 wherein, when the wick is in its extended position, the second end of the wick is in close proximity to a portion of the evaporating surface.

16. The appliance of claim 15 wherein the wick is spaced from the evaporating surface a sufficiently small distance so that, during actuation of the dosing device, a droplet of water protruding off a surface of the wick can come into contact with the evaporating surface.

17. The appliance of claim 1 wherein the wick touches an evaporating surface of the evaportor chamber upon actuation of the dosing device.

18. The appliance of claim 1 wherein the forward and reverse stroke liquid dosing device is integrated with a liquid container, forming an integral assembly.

19. The appliance of claim 1 wherein the forward and reverse stroke liquid dosing device is integrated with a liquid container, forming an integral assembly.

20. The appliance of claim 1 wherein integration of the forward and reverse stroke dosing device and the liquid container comprise a piston/cylinder-type structure, said dosing device comprising the cylinder and said liquid container comprising the piston.

21. The appliance of claim 1 wherein the amount of liquid delivered to the evaporator chamber is dependent upon stroke length of the dosing device.

22. The appliance of claim 19 further comprising a spring configured to return the integral assembly from an extended position, at the end of the forward stroke, to a normal, starting stroke position.

23. The appliance of claim 18 wherein the liquid container of the integral assembly includes a deformable wall.

24. The appliance of claim 23 wherein said deformable wall is outwardly curved.

25. The appliance of claim 1 wherein the liquid delivered to the evaporator chamber is perfumed.

26. The appliance of claim 1 wherein the liquid delivered to the evaporator chamber comprises a hair-treating substance.

27. The appliance of claim 1 wherein the liquid container that holds the liquid delivered to the evaporator chamber is removable.

28. The appliance of claim 1 wherein the liquid container is replaceable.

29. The appliance of claim 18 wherein the integral assembly is fitted into a pocket in the appliance for shaping the hair by a bayonet closure.

30. The appliance of claim 29 wherein the bayonet closure comprises a protrusion extending radially from an outer surface of a liquid container and a recess on a complementary female sleeve.

31. The appliance of claim 30 wherein the bayonet closure includes two or more radially extending protrusions and the corresponding recesses on the female sleeve.

32. The appliance of claim 28 wherein the removable liquid container includes an inlet and replaceable cap configured to seal the inlet.

33. The appliance of claim 1 wherein a sealing ring separates the liquid container and the evaporator chamber.

34. The appliance of claim 1 further comprising a combustion-heating device, including catalyst and a steam distributor chamber wherein said catalyst and steam distributor chamber are formed in a common housing.

35. A hair-shaping appliance comprising:

a tubular drum to treat the hair, the tubular drum having through-passages;

a heating device;

a dosing device, that upon actuation, passes liquid out of an outlet of a liquid container through a liquid channeling device;

an evaporating device, to which heat is supplied by the heating device to evaporate the liquid into steam, which travels to a steam distributor chamber and flows outward through the tubular drum having through-passages;

a liquid container, in fluid communication with the evaporator chamber, constructed to contain a supply of the liquid and including an outlet, and a liquid channeling device, in fluid communication with the outlet, for delivering liquid from the outlet to the evaporator chamber, the liquid channeling device comprising a wick;

wherein said dosing device is configured to remove excess liquid from the evaporator chamber and convey the liquid back to the liquid container.

* * * * *